United States Patent [19]

Dunshee

[11] Patent Number: 4,685,578

[45] Date of Patent: Aug. 11, 1987

[54] TAMPER INDICATION SYSTEM

[75] Inventor: Wayne K. Dunshee, Maplewood, Minn.

[73] Assignee: Minnesota Mining and Manufacturing Company, St. Paul, Minn.

[21] Appl. No.: 905,872

[22] Filed: Sep. 10, 1986

[51] Int. Cl.[4] ..... B65D 55/02

[52] U.S. Cl. ..... 215/230; 206/807

[58] Field of Search ..... 220/214; 215/230, 203, 215/365, 250, 253, 260, 271; 206/807, 459

[56] References Cited

U.S. PATENT DOCUMENTS

| | | | |
|---|---|---|---|
| 3,450,129 | 6/1969 | Avery et al. | 128/2 |
| 3,700,529 | 10/1972 | Monaghan | 156/510 |
| 3,776,220 | 12/1973 | Monaghan | 128/2 W |
| 4,462,224 | 7/1984 | Dunshee et al. | 62/530 |
| 4,480,760 | 11/1984 | Schonberger | 215/230 |
| 4,511,052 | 4/1985 | Klein et al. | 215/230 |
| 4,519,515 | 5/1985 | Schonberger | 215/230 |
| 4,591,062 | 5/1986 | Sandhaus | 215/230 |

*Primary Examiner*—George T. Hall

*Attorney, Agent, or Firm*—Donald M. Sell; James A. Smith; Mark A. Litman

[57] ABSTRACT

A sheet or strip of material has compartments or cavities therein, at least some of which contain materials flowable under pressure such as liquids. Upon the application of pressure, liquid will move within the sheet to contact or penetrate other compartments. The contact between the displaced liquid and other materials within the sheet create a color change which is visually observable. A color change thus indicates that sufficient pressure has been applied to the sheet to cause internal transfer of the liquid. These sheets can be used on packages and containers such as boxes, cartons, jars, bottles and the like. The selection of a sheet which ruptures at a chosen threshold pressure can be used to indicate if an undesirable level of pressure, such as that necessary to twist open a cap, had been applied to the article underneath the sheet.

19 Claims, 4 Drawing Figures

TAMPER INDICATION SYSTEM

BACKGROUND OF THE INVENTION

1. Field of the Invention

The present invention relates to sheets, strips, or films which undergo a visually observable color change in localized areas upon the application of pressure. The indicator can show that undesirable levels of pressure have occurred as by impact or tampering.

2. Background of the Art

It is highly desirable to have an indication of any violation of the integrity of a package or of any impact which might cause damage to the contents of a package.

Plastic wraps provide some indication of tampering, but evidence of tampering can be masked. Heat shrunk wraps are often applied to containers, but these can be softened, removed and replaced.

Under the lid devices have been used which change color upon rotation of the lid. These indicators generally have a transparent portion on the lid through which the color change can be viewed as shown in U.S. Pat. Nos. 4,480,760 and 4,519,515.

Packs for producing either useful reactions or chemical agents, having compartments of individual ingredients, at least one of which is a liquid, are constructed with rupturable seams between the compartments. The seams between the compartments are ruptured, mixing the ingredients still contained within the pack, to produce the desired effect, such as heat storage. Such a system is described in U.S. Pat. No. 4,462,224.

BRIEF DESCRIPTION OF THE INVENTION

Sheets, films or strips which are capable of undergoing visible color changes when subjected to predetermined levels of pressure are used as indicators over articles where it is desirable to know if there has been excessive pressure on or tampering with the article. The indicators are placed on those areas of the article that can best indicate impact or tampering.

DETAILED DESCRIPTION OF THE DRAWINGS

Figure 1:
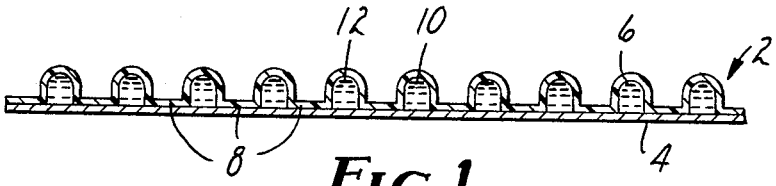
FIG. 1 shows a sectional view of an indicator strip 2 having adjacent compartments 10 and 12 of different materials which are capable of reacting to form a color different from the original observable color of the reactants.

FIG. 1 shows an indicator strip 2 comprised of a back layer 4 and an upper compartment forming layer 6. The back layer 4 and the upper layer 6 cooperate to form adjacent compartments 10 and 12 which are separated by a rupturable seam 8. The adjacent compartments 10 and 12 contain different ingredients, at least one of which readily flows, so that upon contact of the ingredients after rupture of seam 8, a visible color change occurs.

Figure 2:
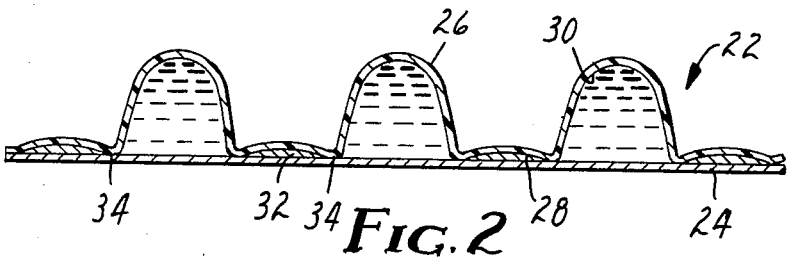
FIG. 2 shows a section of an indicator strip 22 having a liquid 30 within pressure rupturable compartments 26 which will act with ingredients 32 within pockets 28 to form a visible color upon rupture of seams 34 which separate liquid 30 and ingredients 32.

FIG. 2 shows a section of an indicator strip 22 formed by a back layer 24 and an upper layer 26. The back layer 24 and upper layer 26 cooperate to form compartments 30 and pockets 28. The compartments 30 and pockets 28 are separated by a rupturable area 34. The pocket 28 contains an ingredient 32 which can react with the material within the compartments 30. Either material may be flowable, such as a liquid or paste, but it is preferred that at least the material within the compartments 30 is a liquid.

Figure 3:
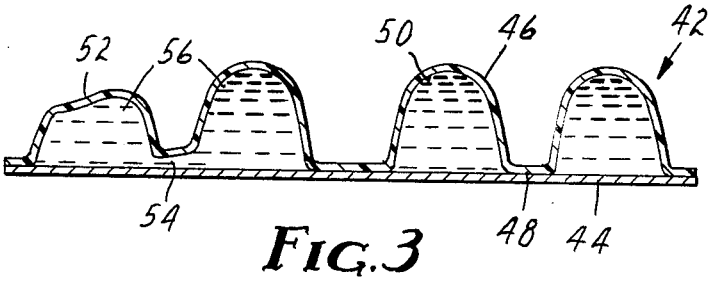
FIG. 3 shows a ruptured indicator strip 42.

FIG. 3 shows a partially ruptured indicator strip 42. The back layer 44 and the upper layer 46 cooperate to form compartments 50 separated by rupturable areas 48. One of the compartments 52 has been compressed by a force sufficient to rupture the separating areas 54. The rupture allows commingling and interaction of ingredients from within adjacent compartments 56. The mixed ingredients still remain confined between layers 44 and 46. The interaction of these ingredients causes a visible color change.

Figure 4:
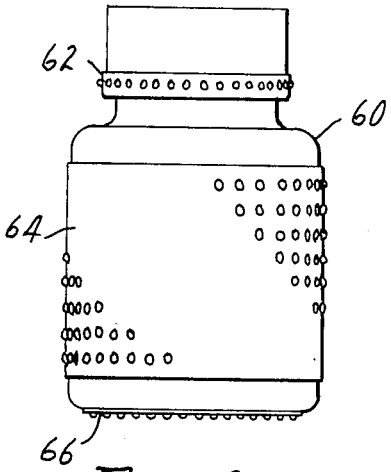
FIG. 4 shows a bottle 60 having three separate indicator strips, 62, 64 and 66 strategically located to show areas where pressure would be applied in opening the bottle 60.

FIG. 4 shows a bottle 60 having three separate indicator strips 62, 64 and 66 on three different areas of the bottle which could be subjected to pressure during an attempt to open the bottle.

DETAILED DESCRIPTION OF THE INVENTION

The indicator strips of the present invention comprise four different parts: an upper layer, lower layer, and two reactive ingredients. An upper layer cooperates with a lower layer to form pockets or compartments with rupturable areas between compartments. In the compartments or in the compartments and the areas between the compartments are two separate reaction ingredients which when mixed provide a color change.

At least one of the upper and lower layers should be transparent or translucent so that a color change can be observed. The outermost layer when the indicator strip is applied to an article is most preferably the layer through which a visible change can be viewed.

The upper layer is preferably a polymeric film forming material. The film is applied to the lower layer by conventional packaging techniques so as to form adjacent compartments with rupturable areas between them. Means similar to those used in forming individually dispensable pills on backing sheets and processes and materials like those described in U.S. Pat. No. 4,462,224 can be used to manufacture the indicators of the present invention. Preferred polymers are polyesters, polyolefins, polyvinyls, polyamides, polycarbonates, polyvinyl acetals, cellulose esters, and the like. Heat shrinkable polymers such as heat shrinkable polyesters (polyethylene terephthalate) and heat shrinkable polyamides are preferred.

The lower layer tends to be more of a structural support layer for the composite article. This layer may be made of the same composition as the upper layer, but because it need not be transparent, it may also comprise other materials. For example, the lower layer may be foil, coated paper, artificial paper and the like. The lower layer should not be readily penetrable by the flowable (e.g., liquid) composition within the indicator strip if that layer is in direct contact with the liquid.

It is generally easier to form the composite indicator strip of the present invention if the upper layer is more flexible, conformable, and/or thinner than the lower layer. This is useful because the upper layer conforms to (or actually shapes) the shape of the flowable material or at least is formed around that material so as to restrict its movement within the indicator.

The two components which form a color change when comingled can be selected from an extremely wide range of materials with vastly different functional mechanisms. The mechanism by which a color change is effected need not be merely colorless to colored. The change may also be from colored to colorless, one color to another, or one color density to another. Any readily visible change is acceptable. Such varied mechanisms as leuco dye oxidation, dye bleach, chemical reaction to form dyes, wetting of powders to intensify colors, and other well known systems could be used. Incorporation into the structure of the present invention can be easily done. The oxidation, bleach and reaction systems can be readily formulated into two different liquid compositions, and the two liquids placed in a pattern of distribution so that alternative compartments contain different ingredients. Powders can also be used in alternate compartments, but can also be used in pockets between compartments as shown in FIG. 2.

Various imaging materials such as those disclosed in U.S. Pat. Nos. 4,111,462, 4,104,437, 3,920,863, 3,682,673, 4,379,835 (and monocolor equivalents) and 4,370,020 can be used without the need for binders by separating the oxidizing agents from the colorant or leuco dye. Powder compositions even as simple as powdered fruit drinks (e.g., powdered sugar and food coloring) can be successfully used with water in the alternative compartments.

After the indicator strips or sheets have been formed, they may be attached by any convenient means. The indicators may be secured by an adhesive (e.g., pressure-sensitive, thermal or solvent), heat shrinking of the lower layer, or a complete wrapping of the article.

These and other aspects of the invention will be shown in the following non-limiting examples.

EXAMPLE 1

Two sheets of heat shrinkable film comprising a laminate of $2.54\times10^{-5}$ m nylon/saran blend over $7.6\times10^{-5}$ m low density polyethylene were chosen. A thermoforming mold having hemispherical depressions 3 mm in diameter and with 1 mm between them was used to alternatively encapsulate phenolphthalein and 2% triethanolamine in water. The molding process used seal procedures and temperatures as described in the examples of U.S. Pat. No. 4,462,224 to provide compartments that were permanently fused in one direction but rupturably sealed in the other direction. Strips of film were cut in lines through the permanently sealed areas after a pressure-sensitive adhesive was applied to the backside. Strips of three columns of compartments were cut and wrapped about the lid and the middle of a bottle of aspirin. Two more strips were applied to the top and bottom of the bottle.

The application of sufficient force to open the top of the bottle ruptured some of the compartments causing the phenolphthalein and ethanolamine to mix. The color within the indicator changed from colorless to pink.

EXAMPLE 2

A sheet like that of Example 1 was made except that the compartments alternatively contained water or a commercially available powdered cherry fruit drink mix. Upon rupture of the separator areas between compartments, the powder changed from a mild pink to a bright red.

EXAMPLE 3

A lower sheet of polyethylene coated paper was used with an upper sheet of film like that used in Example 1. A saturated solution of a colorless phthalazine leuco dye was used in one set of compartments and a solution of nitric acid used in alternative compartments. Pressure-sensitive adhesive was used between the compartments, with the mold designed to have four times the dimensions between columns than between rows. After securing the paper and film together, strips were made by cutting between columns. The strips were pasted to boxes and the boxes dropped. Color was displayed by the compartments in areas where the box struck the ground and areas between compartments ruptured.

What is claimed is:

1. An indicator for indicating that pressure has been applied thereto comprising an upper layer and a lower layer, said layers cooperating to form a series of compartments separated by rupturable areas, at least some of the compartments containing a flowable material and either the area between compartments or adjacent compartments containing a second material which when mixed with said flowable material causes a color change in either of said materials which is viewable through at least one layer.

2. The indicator of claim 1 wherein at least some adjacent compartments contain separate liquid compositions which when they are mixed cause said color change.

3. The indicator of claim 2 wherein said separate liquid compositions are colorless and form a color when mixed.

4. The indicator of claim 1 wherein at least some adjacent compartments alternately contain a liquid and a solid which when intermixed cause a color change.

5. The indicator of claim 1 wherein said upper layer and lower layer are organic polymeric film forming materials.

6. The indicator of claim 2 wherein said upper layer and lower layer are organic polymeric film forming materials.

7. The indicator of claim 3 wherein said upper layer and lower layer are organic polymeric film forming materials.

8. The indicator of claim 1 wherein said rupturable areas between compartments are thermally sealed areas.

9. The indicator of claim 1 wherein said rupturable areas between compartments are secured by an adhesive.

10. An article having an indicator secured thereon wherein said indicator comprises the indicator of claim 1.

11. An article having an indicator secured thereon wherein said indicator comprises the indicator of claim 2.

12. An article having an indicator secured thereon wherein said indicator comprises the indicator of claim 3.

13. An article having an indicator secured thereon wherein said indicator comprises the indicator of claim 6.

14. An article having an indicator secured thereon wherein said indicator comprises the indicator of claim 7.

15. An article having an indicator secured thereon wherein said indicator comprises the indicator of claim 8.

16. An article having an indicator secured thereon wherein said indicator comprises the indicator of claim 9.

17. The article of claim 10 wherein said article comprises a container chosen from a box, carton, bottle or jar.

18. The article of claim 11 wherein said article comprises a container chosen from a box, carton, bottle or jar.

19. The article of claim 6 wherein said article comprises a container chosen from a box, carton, bottle or jar.

* * * * *